US005294180A

United States Patent [19]

Grimm

[11] Patent Number: 5,294,180

[45] Date of Patent: Mar. 15, 1994

[54] ADJUSTABLE FOOT REST

[75] Inventor: Thomas M. Grimm, Robbinsdale, Minn.

[73] Assignee: Ergodyne Corporation, St. Paul, Minn.

[21] Appl. No.: 928,977

[22] Filed: Aug. 12, 1992

[51] Int. Cl.[5] ..... A47C 9/12

[52] U.S. Cl. ..... 297/423.44; 297/423.45; 297/423.46; 297/344.12

[58] Field of Search ..... 297/329, 439, 345; 248/161, 178

[56] References Cited

U.S. PATENT DOCUMENTS

| | | | |
|---|---|---|---|
| 2,298,087 | 10/1942 | Stechbart | 248/178 X |
| 4,432,108 | 2/1984 | Chapman | 297/439 X |
| 4,441,758 | 4/1984 | Fleischer et al. | 297/439 |
| 5,088,668 | 2/1992 | Grimm | 248/118.3 |
| 5,201,568 | 4/1993 | Christensen | 297/439 |

*Primary Examiner*—Peter M. Cuomo
*Assistant Examiner*—Jerry Redman
*Attorney, Agent, or Firm*—Merchant, Gould, Smith, Edell, Welter & Schmidt

[57] ABSTRACT

A foot rest (10), being positioned on a generally planar surface, includes a generally cylindrical sector support member (20), having an outer surface (21) and an inside surface (22). A generally cylindrical sector base member (30) has an outside surface (31) and inner surface (32). The inside surface (22) is positioned proximate the outside surface (31) and the members (20 and 30) are substantially concentric. A platform member (50) is operatively connected to the support member (20). The platform member (50) has pivotally mounted thereto a foot lock lever (40). A bolt (60) is used to lock the members (30 and 20) in a plurality of relative positions after relative rotational movement between the members (20 and 30), thereby defining a plurality of heights of the foot rest with respect to the planar surface.

19 Claims, 5 Drawing Sheets 50
20
6
28
54
6
70
44
56
4
4
23
43
40
42
53
55
27

FIG. 4
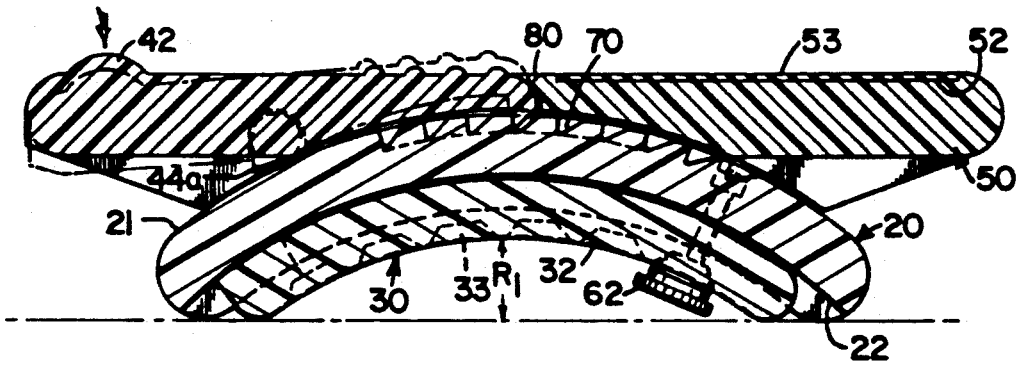
FIG. 5
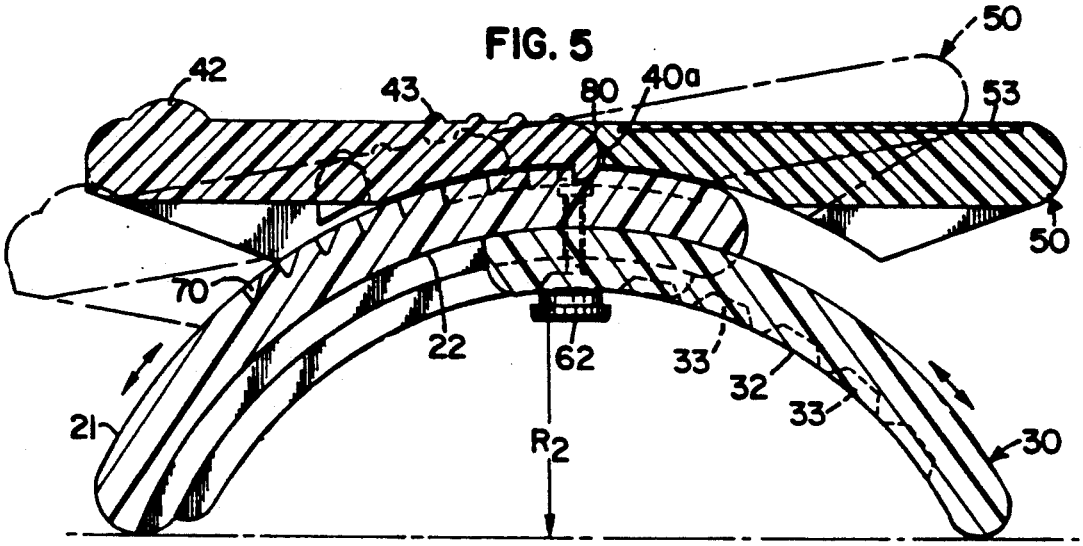
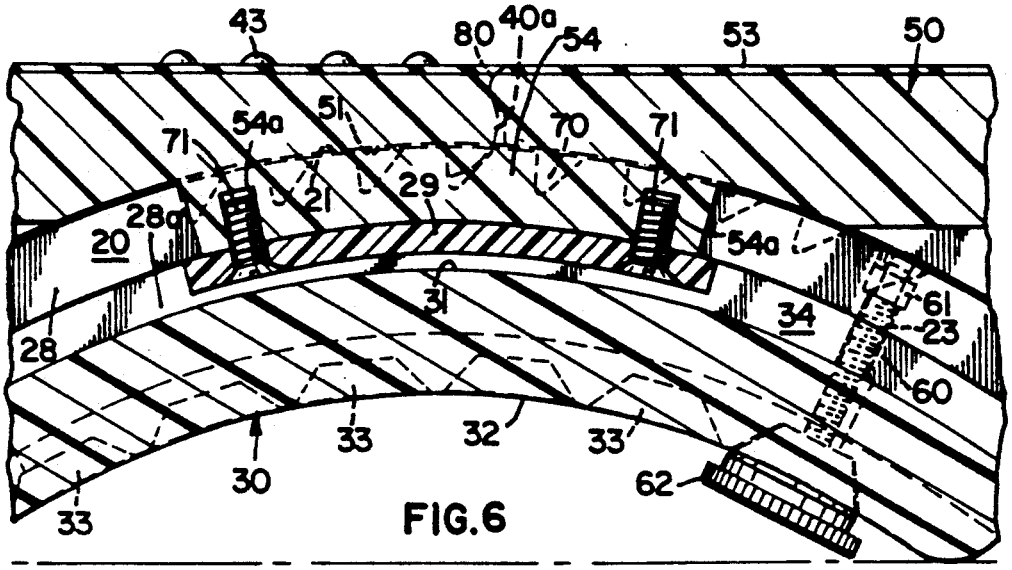
FIG.6

ADJUSTABLE FOOT REST

BACKGROUND OF THE INVENTION

1. Field of the Invention

This invention relates generally to foot rests, and more particularly to foot rests which incorporate an adjustment to easily vary the height of the foot rest and may also include an adjustment to vary the angle of the platform of the foot rest.

2. Description of the Prior Art

Foot rests are well known in the art. Foot rests are utilized for a variety of purposes. One of the most common is when the foot rest is used in conjunction with a person seated at a chair. A properly adjusted foot rest allows the user sit much more comfortably and in a more ergonomicly correct position.

In order to obtain the more ergonomicly correct position, it is desirable to have the foot rest adjustable in height and also be able to adjust the angle of inclination of the foot rest platform. The present invention addresses these two issues by providing for a foot rest that is not only adjustable in height, but also has a platform whose angle of inclination may be adjusted. Still further, a unique foot lock is provided which allows for the platform to either be locked in a variety of positions or be left in a position wherein the foot rest platform may articulate freely.

SUMMARY OF THE INVENTION

The invention is a foot rest for supporting a user's feet. The foot rest is positioned on a generally planar surface and includes a generally cylindrical sector support member having an outer surface and an inside surface. A generally cylindrical sector base member has an outside surface and an inner surface. The inner surface of the support member is positioned proximate the outside of the base member. The base member and support member are substantially concentric. A platform member is operatively connected to the support member and there is a means for locking the members in a plurality of relative positions after relative rotational movement between the members, thereby defining a plurality of heights of the foot rest with respect to the planar surface.

In a preferred embodiment, the foot rest further includes a means for adjusting the platform in a plurality of positions with respect to the support member. The adjusting means may also include a means for limiting articulation of the platform and when not set in position, the platform is free to articulate within a given range of motion.

In a preferred embodiment, the foot rest also includes a detent formed in the platform member. The detent is positioned proximate the first end of the lever arm and the detent is sized and configured to resist the lever arm in moving from a locked position when the latch member is located in the adjustment slot and further to resist the lever arm from returning to the locked position when the lever arm is an unlocked position.

BRIEF DESCRIPTION OF THE DRAWINGS

FIG. 4 is a cross-sectional view of the foot rest shown in FIG. 3, taken generally along the lines 4—4.

FIG. 5 is a cross-sectional view of the foot rest shown in FIG. 3, taken generally along the lines 4—4 after relative rotational movement between the support member and base member.

FIG. 6 is an enlarged cross-sectional view taken generally along the line 6—6 of the foot rest shown in FIG. 3.

DETAILED DESCRIPTION OF THE PREFERRED EMBODIMENT

Figure 1:
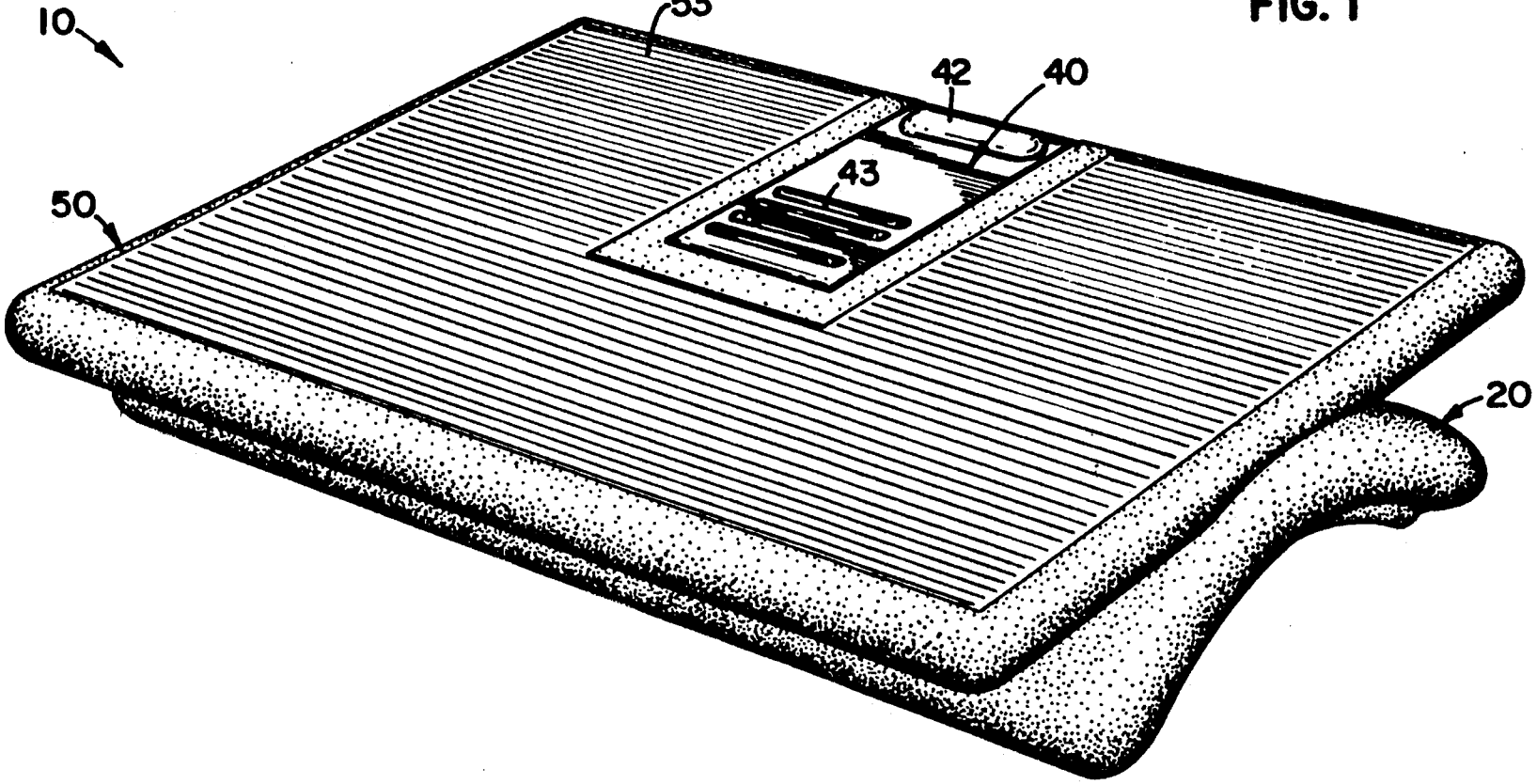
FIG. 1 is a perspective view of the foot rest incorporating my present invention.

Referring to the drawings, wherein like numerals represent like parts throughout the several views, there is generally disclosed at 10 a foot rest. The foot rest 10 includes a support member 20, base member 30, foot lock lever 40, and platform member 50.

Figure 2:
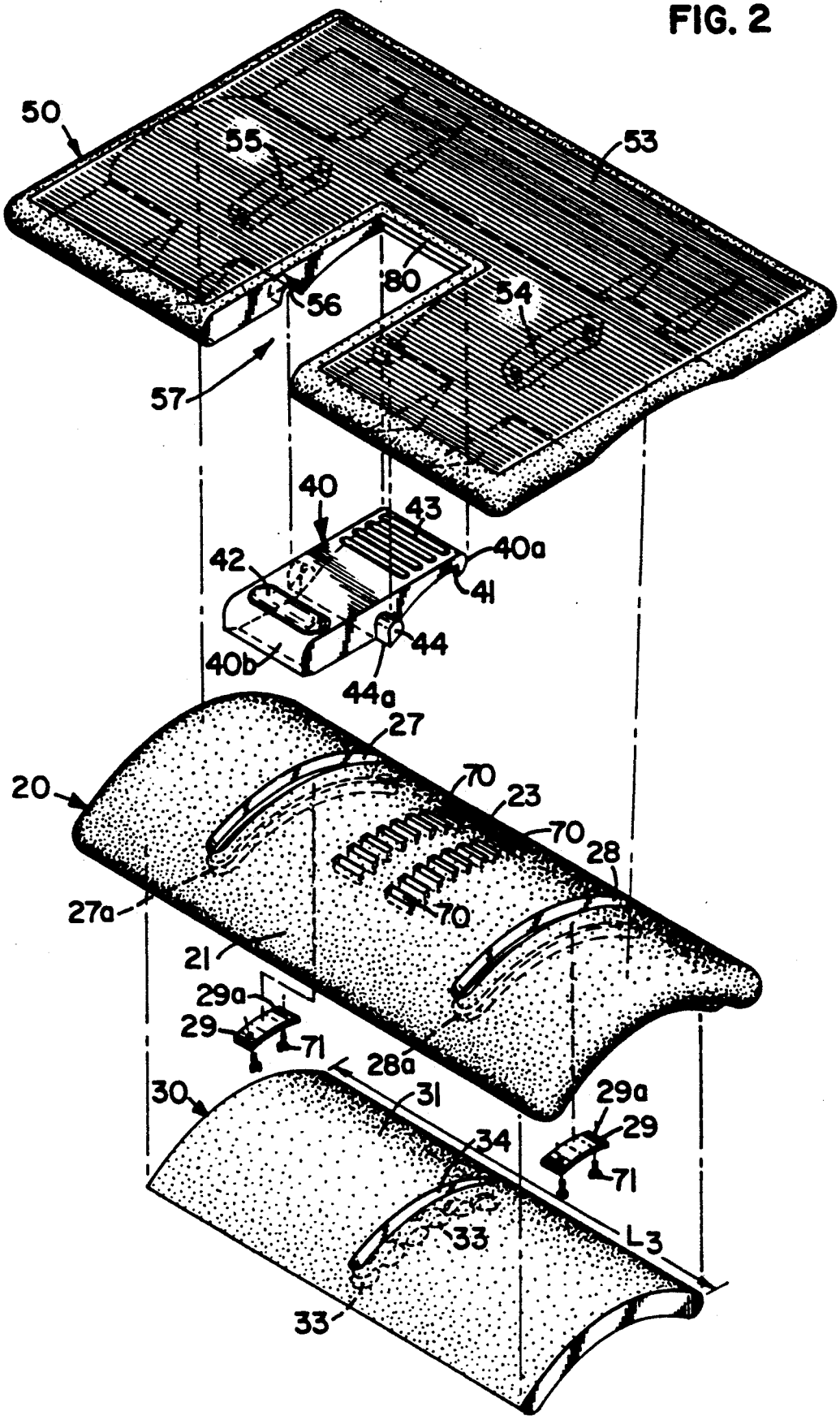
FIG. 2 is an exploded view of the foot rest shown in FIG. 1.
Figure 3:
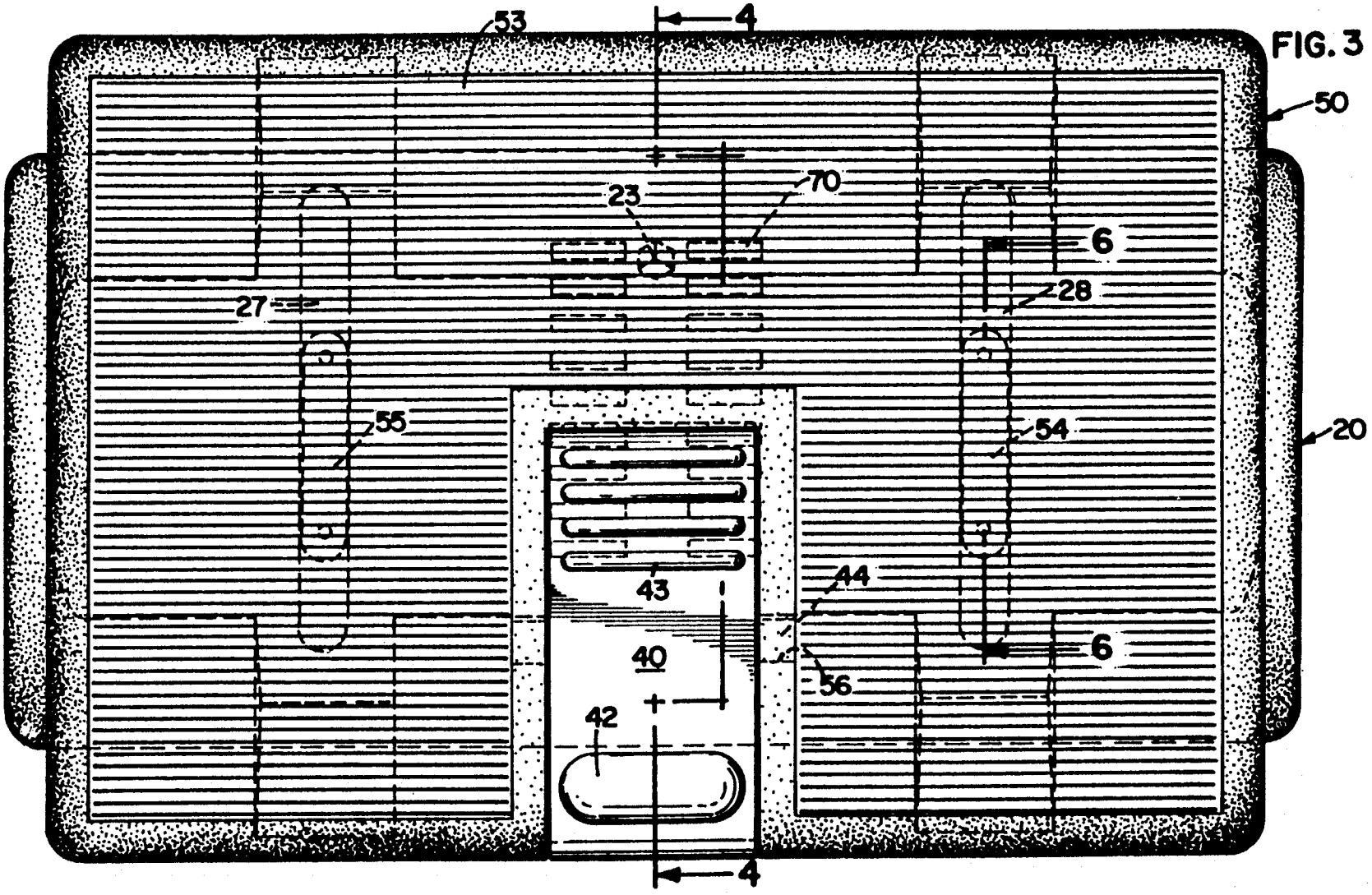
FIG. 3 is a top plan view of the foot rest shown in FIG. 1.

The support member 20 has an outer surface 21 and an inside surface 22. As shown in FIGS. 2 and 8, the support member 20 also includes a right end section 25 and a left end section 26. That portion of the support member between the end sections 25 and 26 forms generally a cylindrical sector and the length of the cylindrical sector is shown as $L_1$ and the overall length of the support member is shown as $L_2$. A bore 23 is formed through the support member 20 between the outer surface 21 and inside surface 22. The end sections 25 and 26 are higher than the support member 20 at the inside surface 22. This forms a cavity into which the base member 30 is positioned, as will be described more fully hereinafter. Two generally parallel slots 27 and 28 are formed in the support member 20. The slots are substantially similar and only one will be described in detail, it being understood that the other slot is similar. The slot 27 has an enlarged recess **27*a* in to which a plate 29 is positioned. The plate 29 has a height which is equal to or less than the height of the recess such that the bottom surface of the plate 29 is coplanar than the inside surface 22. As shown in FIG. 6, the plate 29 is somewhat lower, so that there is a clearance with outside surface 31. The plate 29 is curved and has a radius which is equal to the radius of the recessed area 27*a* so that the plate 29 may easily slide in the slot 27. The width of the plate 29 is just slightly less than the width of the recess 27*a* and it is free to slide along the recess 27*a* until it hits the end walls 27*b* or 27*c* of the recess 27*a*. The plate 29 has two countersunk holes 29*a* and 29*b* formed therein. A similar plate 29 is positioned in the recess 28*a* of slot 28 which has end walls 28*b* and 28*c*. A plurality of adjustment slots 70 are formed in the outer surface 32 of the support member 20. The adjustment slots 70 are formed in two generally parallel rows and there are at equal increments between the slots in each parallel row. Therefore, two adjustment slots 70, in the parallel rows, are in alignment and form a set of slots for engagement with a foot lever 40**, which will be described more fully hereafter.

The base member 30, as shown in FIG. 2, has an outside surface 31 and an inside surface 32. The outside surface 31 is generally arcuate in shape and the base member 30 has the general shape of a cylindrical sector. The outside surface 31 and inside surface 32 are concentric and are arranged and configured for relative rotational movement. The base member 30 has a length $L_3$ which is substantially the same, but slightly less than the length $L_1$ of the support member. Thereby, the base member 30 is held in position when it is free to move relative to the support member 20. A slot 34 is formed in the outside surface 31 of the base member 30. The slot 34 is connected to a plurality of openings 33 which are formed in the inner surface 32 of the base member 30.

Figure 7:
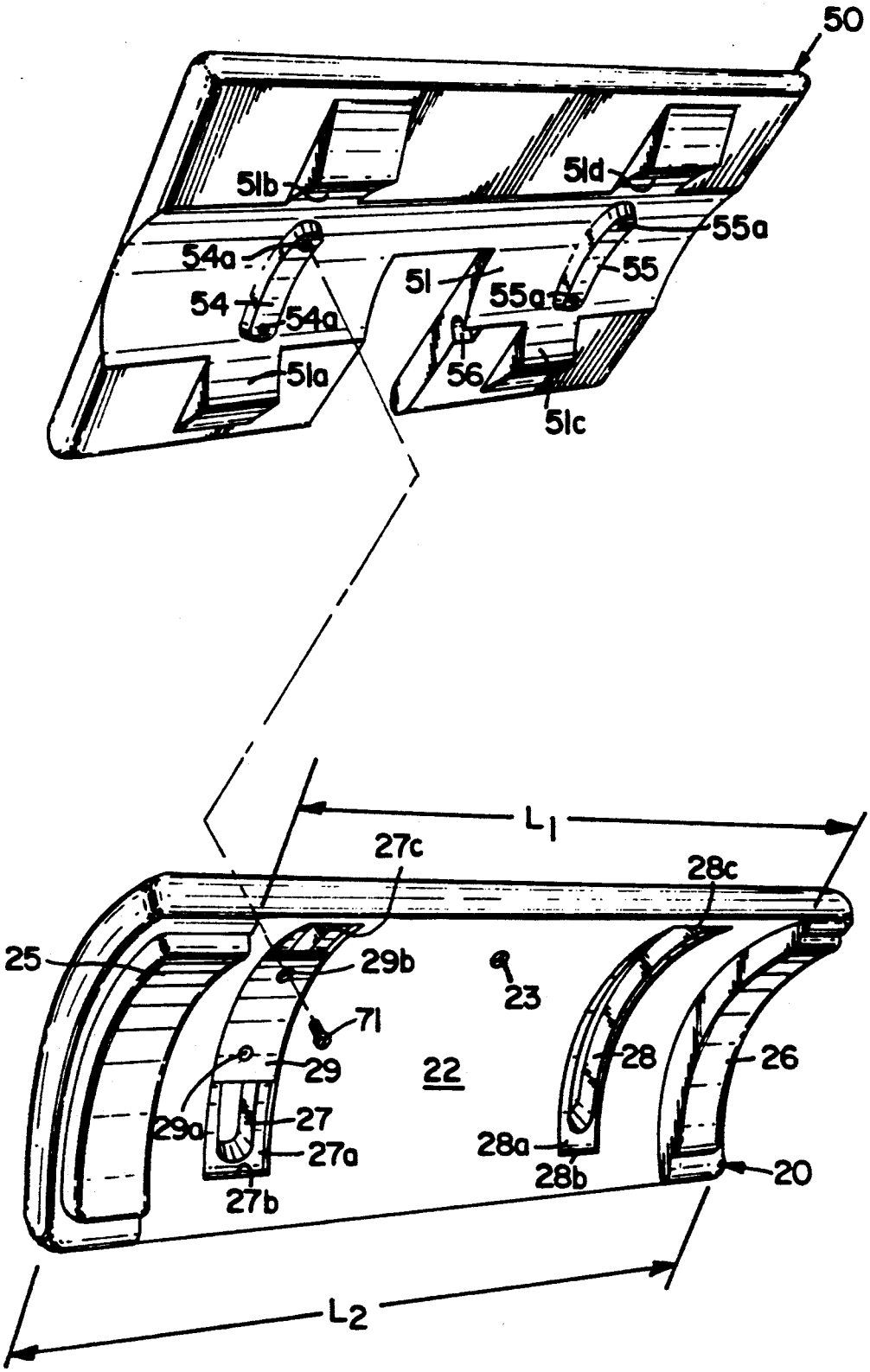
FIG. 7 is an exploded perspective view of the bottom of the platform member and support member of the foot rest shown in FIG. 1.

The platform member 50 has a generally top planar surface 52 that is slightly recessed. Operatively connected in the recess is a non-skid material 53. The material 53 may be secured by any means well known in the art such as by the use of an adhesive. A generally rectangular slot 57 is formed in the platform member 50. The configuration of the slot 57 is sized to match that of the foot lock lever 40, which will be described more fully hereafter. The underneath side of the platform member 50 includes a bottom surface 51 which is generally arcuate in shape. The arcuate shaped bottom member is located in the central portion of the underneath surface. Four extensions of the arcuate surface 51 are shown in FIG. 7 as 51*a*, 51*b*, 51*c* and 51*d*. As will be more fully described hereafter, the surfaces 51 and 51*a* through 51*d* form a surface on which the support member 20 may rotate.

A foot lock lever is generally designated as 40. The lever 40 has a first end 40*a* and a second end 40*b*. The foot lock lever 40 has the same general size as the slot 57 in the platform member 50. Accordingly, when in position the lever 40 and platform 50 have a generally planar surface. A latch member 41 is operatively connected to the first end 40*a*. The latch member 41 is sized and configured to be inserted in the adjustment slots 70. Accordingly, with the two parallel rows of adjustments slots 70, the latch member 41 would have two segments which would extend downward and enter the adjustment slots 70. If the adjustment slots 70 were continuous between the two parallel rows, the latch member 41 could then be one continuous latch member. Protrusion 42 and strips 43 are operatively connected to the top surface of the lever 40 and both provide a sensory input to a user's foot for use during the operation of the lever 40. Pivots 44 are operatively connected to both sides of the lever 40 and cooperate and are positioned in the pivot openings 56 formed in the platform member 50.

The support member 20, base member 30 and platform member 50 may be made out of any suitable material and process, such as a blow molded plastic such as polyethylene. The foot lock lever 40 may be made by injection molding and made from suitable materials such as ABS or styrene. Each of the individual pieces would then be a single unitary piece. However, it is understood that other suitable materials and methods of construction may be utilized.

In use, the base support member 30 is placed underneath the support member 20 between the end sections 25 and 26. The outside surface 31 and inside surface 22 are concentric such that the support member 20 and base member 30 allow for relative rotational movement between the two members. A bolt 60 is then placed through one of the openings 33 and through the slot 34 into the bore 23. As shown in FIG. 4, the bolt 60 is inserted into one of the openings 33 which is furthest to the right, when viewed in FIG. 4. The bolt is then inserted through the bore 23 and into the nut 61. The nut 61 is sized to have a cross-sectional area similar to the cross-section at the top of the bore 23, which is larger than the bore 23 itself. Since the nut is sized approximately the same as the enlarged portion, the nut does not rotate and is held in position as the bolt 60 is rotated through the nut 61 by turning the head or knob 62. This configuration results in a radial height $R_1$. As shown in FIG. 5, the base member 30 may be rotated relative to the support member 20. This is done after removal of the bolt 60. The bolt 60 is then placed through the opening 33 which is furthest to the left in the base member 30 and again inserted and threaded through the nut 61 which is in the same bore 23. This results in a different radial height $R_2$ which is greater than the first radial height $R_1$. Therefore, the overall height of the foot rest 10 may be changed by rotating and securing in position the base member 30 with respect to the support member 20.

In constructing the foot rest 10, the foot lever 40 is first inserted into the rectangular slot 57 and the pivots 44 are positioned in the pivot openings 56. Then, the outer surface 21 of the support member 20 is placed in position under the platform 50 so as to come in contact with the bottom surfaces 51 and 51*a* through 51*d*. Referring to FIG. 7, clamps 29 are placed in the slot recesses 27*a* and 28*a* and are connected to bosses 54 and 55 by suitable means such as screws 71 which enter holes 54*a* and 55*a* formed in the respective bosses 54 and 55. The screws 71 are tightened sufficiently so as to operatively connect the support member 20 to the platform 50 and allow for the clamps 29 to slide in the recesses 27*a* and 28*a*. The second clamp 29 for use in slot 28 is not shown in this FIG. 7, it being understood two are used, as shown in FIG. 2. However, the screws are not tightened so much that the clamp binds against the support member 20 so that it is not free to slide in the recesses 27*a* and 28*a*. Without the foot lock lever 40, the platform 50 would be free to articulate or rotate along the outer surface 21 of the support member 20 and the rotation would be limited only until the clamps 29 came into contact with either the end walls 27*b* and 27*c*. In a preferred embodiment, the end walls 27*b* and 27*c* and 28*b* and 28*c* are positioned such that there is a degree of rotation of approximately 30° is allowed.

The articulation or rotation of the platform 50 with respect to the support member 20 is about the concentric arcuate surfaces 21 and 51. In FIG. 6, for illustration purposes only, these two surfaces 21 and 51 are shown as two separate lines and a very small space in between. However, this is done illustrative purposes only, it being understood that the two surfaces would actually be in contact during use.

In FIG. 4, the foot lock lever 40 is shown in the locked position and in an unlocked position in phantom. When in a locked position, the latch member 41 is positioned in one pair of the adjustment slots 70. A detent 80 is formed in the platform member which would be proximate the first end 40*a* of foot lock lever 40. When in the locked position, the detent 40 is positioned slightly over the end of the the first end 40*a* of foot lock lever 40 to hold it in a locked position. Then, when it is desired to move the foot lock lever 40 to an unlocked position, pressure is placed on the protrusion 42 and the foot lock lever 40 is forced to pivot on the pivots 44 and the the first end 40*a* of foot lock lever 40 is forced up past the detent 80. This is the position shown in phantom in FIG. 4. The pivot 44 has a tip 44*a* which, when it comes in contact with the outer surface 21, prevents further rotation of the foot lock lever 40. In this position, the detent 80 also resists movement of the foot lock lever 40 to move from this unlocked position to the locked position. The movement is resisted because the detent extends underneath the the first end 40a of foot lock lever 40. To move the foot lock lever 40 to the locked position, it is necessary to apply pressure to the foot lock lever 40 proximate the strips 43. This forces the the first end 40a of foot lock lever 40 past the detent and into the locked position. In FIG. 5, the platform member 50 is shown, in phantom, in a rotated position. To reach this rotated position, it was necessary for the foot lock lever 40 to be moved to the unlocked position and then the platform member 50 was free to articulate or rotate on the outer surface 21. The user has the option of leaving the foot lock lever 40 in an unlocked position wherein the platform member is free to continue to articulate depending on the pressure placed on the platform member 50. Then, when a desired angle is found the foot lock lever 40 is depressed to the locked position.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A foot rest for supporting a user's feet, said foot rest being positioned on an generally planar surface, said foot rest comprising:

(a) a generally cylindrical sector support member having an outer surface and an inside surface;

(b) a generally cylindrical sector base member having an outside surface and an inner surface, said inside surface of said support member positioned proximate said outside surface of said base member, said members substantially concentric;

(c) a platform member operatively connected to said support member; and (d) means for locking said members in a plurality of relative positions after relative rotational movement between said members, thereby defining a plurality of heights of said foot rest with respect to the planar surface.

2. The foot rest of claim 1, wherein said locking means comprises:

(a) a bore formed in said support member;

(b) an opening formed in said base member;

(c) a bolt positioned in said opening and in said bore of said support member;

(d) a nut positioned in said bore; and (e) said bolt having a head, whereby turning said head will lock said support member and said base member in one of a plurality of positions.

3. The foot rest of claim 2, further comprising a plurality of openings formed in said base member, wherein a plurality of preselected positions are available.

4. The foot rest of claim 1, further comprising means for adjusting said platform in a plurality of positions with respect to said support member.

5. The foot rest of claim 4, wherein said adjusting means comprises means for limiting articulation of said platform and when not set in position, said platform is free to articulate within a given range of motion.

6. The foot rest of claim 5, further comprising:

(a) said platform having an arcuate bottom surface which is generally concentric with said outer surface of said support member;

(b) a slot formed in said outer surface, said slot having an elongate axis in the general direction of articulation between said platform and support member; and (c) a plate positioned in said slot for movement along the elongate axis, said plate operatively connected to said platform.

7. The foot rest of claim 6, wherein said slots are sized to limit articulation to approximately 30°.

8. The foot rest of claim 6, wherein said adjusting means further comprises:

(a) a foot lever pivotally mounted in said platform member, said foot lever having a first end and a latch member operatively connected to said first end;

(b) a plurality of adjustment slots formed in said support member, wherein said foot lever may lock said platform member in one of a plurality of positions with respect to said support member.

9. The foot rest of claim 8, further comprising a detent formed in said platform member, said detent positioned proximate said first end of said lever arm, said detent sized and configured to resist said lever arm in moving from a locked position when said latch member is located in said adjustment slot and to resist said lever arm from returning to said locked position when said lever arm is in an unlocked position.

10. The foot rest of claim 5, further comprising:

(a) said platform having an arcuate bottom surface which is generally concentric with said outer surface of said first member;

(b) a slot formed in said outer surface, said slot having an elongate axis in the general direction of articulation between said platform and first member; and (c) a plate positioned in said slot for movement along the elongate axis, said plate operatively connected to said platform.

11. The foot rest of claim 10, wherein said slots are sized to limit articulation to approximately 30°.

12. The foot rest of claim 10, wherein said adjusting means further comprises:

(a) a foot lever pivotally mounted in said platform member, said foot lever having a first end and a latch member operatively connected to said first end;

(b) a plurality of adjustment slots formed in said first member, wherein said foot lever may lock said platform member in one of a plurality of positions with respect to said first member.

13. The foot rest of claim 10, further comprising a detent formed in said platform member, said detent positioned proximate said first end of said lever arm, said detent sized and configured to resist movement of said lever arm from a locked position when said latch member is in a locked position and to resist movement of said lever arm from said locked position when said lever arm is in an unlocked position.

14. A foot rest for supporting a user's feet, said foot rest being positioned on an generally planar surface, said foot rest comprising:

(a) a generally cylindrical sector support member having an outer surface and an inside surface;

(b) a generally cylindrical sector base member having an outside surface and an inner surface, said inside surface of said support member positioned proximate said outside surface of said base member, said members substantially concentric;

(c) a platform member operatively connected to said support member, said platform member having an arcuate bottom surface which is generally concentric with said outer surface of said support member;

(d) a slot formed in said outer surface, said slot having an elongate axis in the general direction of articulation between said platform and support member; and (e) a plate positioned in said slot for movement along the elongate axis, said plate operatively connected to said platform;

(f) means for locking said members in a plurality of relative positions after relative rotational movement between said members, thereby defining a plurality of heights of said foot rest with respect to the planar surface;

(g) said locking means comprises:

(i) a bore formed in said support member;

(ii) an opening formed in said base member;

(iii) a bolt positioned in said opening and in said bore of said support member;

(iv) a nut positioned in said bore; and (v) said bolt having a head, whereby turning said head will lock said support member and said base member in one of a plurality of positions;

(h) means for adjusting said platform in a plurality of positions with respect to said support member, wherein said adjusting means comprises means for limiting articulation of said platform and when not set in position, said platform is free to articulate within a given range of motion;

(i) said adjusting means further comprises:

(i) a foot lever pivotally mounted in said platform member, said foot lever having a first end and a latch member operatively connected to said first end;

(ii) a plurality of adjustment slots formed in said support member, wherein said foot lever may lock said platform member in one of a plurality of positions with respect to said support member; and (j) a detent formed in said platform member, said detent positioned proximate said first end of said lever arm, said detent sized and configured to resist said lever arm in moving from a locked position when said latch member is located in said adjustment slot and to resist said lever arm from returning to said locked positioned when said lever arm is an unlocked position.

15. A foot rest for supporting a user's feet, comprising:

(a) a first member having an outer surface and an arcuate inside surface;

(b) a second member having an inner surface and an arcuate outside surface;

(c) said arcuate inside surface positioned on top of said arcuate outside surface and configured to be rotated relative to each other;

(d) a platform member operatively connected to said first member; and (e) means for locking said surfaces in one of a plurality of positions, whereby said rest may have a plurality of heights.

16. The foot rest of claim 15, wherein said locking means comprises:

(a) a bore formed in said first member;

(b) an opening formed in said second member;

(c) a bolt positioned in said opening and in said bore of said first member;

(d) a nut positioned in said bore; and (e) said bolt having a head, whereby turning said head will lock said first member and said second member in one of a plurality of positions.

17. The foot rest of claim 16, further comprising a plurality of openings formed in said second member, wherein a plurality of preselected positions are available.

18. The foot rest of claim 15, further comprising means for adjusting said platform in a plurality of positions with respect to said first member.

19. The foot rest of claim 18, wherein said adjusting means comprises means for limiting articulation of said platform and when not set in position, said platform is free to articulate within a given range of motion.

* * * * *